US006517922B2

(12) United States Patent
Ang et al.

(10) Patent No.: US 6,517,922 B2
(45) Date of Patent: Feb. 11, 2003

(54) KIT FOR FINISHING CUT EDGES OF FLOOR COVERINGS

(75) Inventors: Anny Ang, Concord (CA); Kate Moffat Devine, Concord (CA)

(73) Assignee: Multy Industries Inc., Concord (CA)

( * ) Notice: Subject to any disclaimer, the term of this patent is extended or adjusted under 35 U.S.C. 154(b) by 109 days.

(21) Appl. No.: 09/770,454

(22) Filed: Jan. 29, 2001

(65) Prior Publication Data

US 2002/0102376 A1 Aug. 1, 2002

(30) Foreign Application Priority Data

Jan. 8, 2001 (CA) ..... 2330408

(51) Int. Cl.[7] ..... A47G 27/04

(52) U.S. Cl. ..... 428/41.8; 428/40.1; 428/121; 428/192; 428/193; 428/194

(58) Field of Search ..... 428/40.1, 41.8, 428/192, 194, 121, 193

(56) References Cited

U.S. PATENT DOCUMENTS 2,599,359 A 6/1952 Banks et al.
4,054,698 A 10/1977 Hamrah
5,209,171 A * 5/1993 Anderson ..... 112/7
6,083,596 A * 7/2000 Pacione ..... 428/62

FOREIGN PATENT DOCUMENTS

| | | |
|---|---|---|
| BE | 884 906 | 2/1981 |
| DE | 958 764 | 2/1957 |
| DE | 299 12 240 | 8/1999 |

* cited by examiner

*Primary Examiner*—Nasser Ahmad

(57) ABSTRACT

A kit for use in finishing a cut edge of floor coverings such as mats, carpets, carpet runners, and roll runners having a cut side edge including an elongated edging strip which has a length equal to or exceeding the length of the cut edge to be finished. The lateral width of the edging strip is selected so that when secured in place, the strip substantially covers and conceals the cut edge. The edging strip includes a flexible ribbon and an attachment member provided to permanently secure the ribbon in position substantially overlapping the cut edge. Preferably, the attachment member comprises a piece of two-sided tape having a length and width generally corresponding to that of the finishing strip. The two-sided tape is secured along a first side to the finishing strip, and a release sheet is carried by and releasably secured to the second other side of the tape. In use, the release sheet is removed to activate the adhesive tape, whereupon the second side of the tape is pressed into contact with the floor covering to secure the finishing strip or ribbon in place.

14 Claims, 3 Drawing Sheets

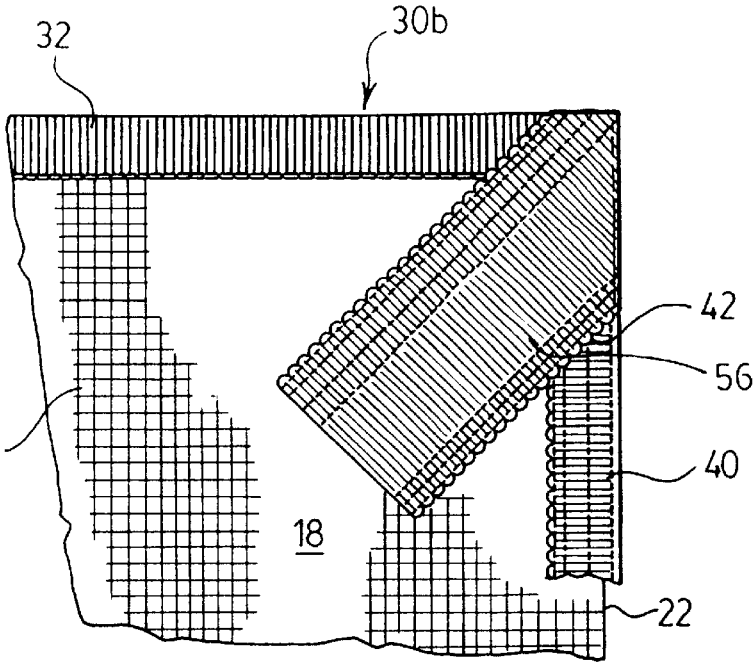
FIG.4.
FIG.5.
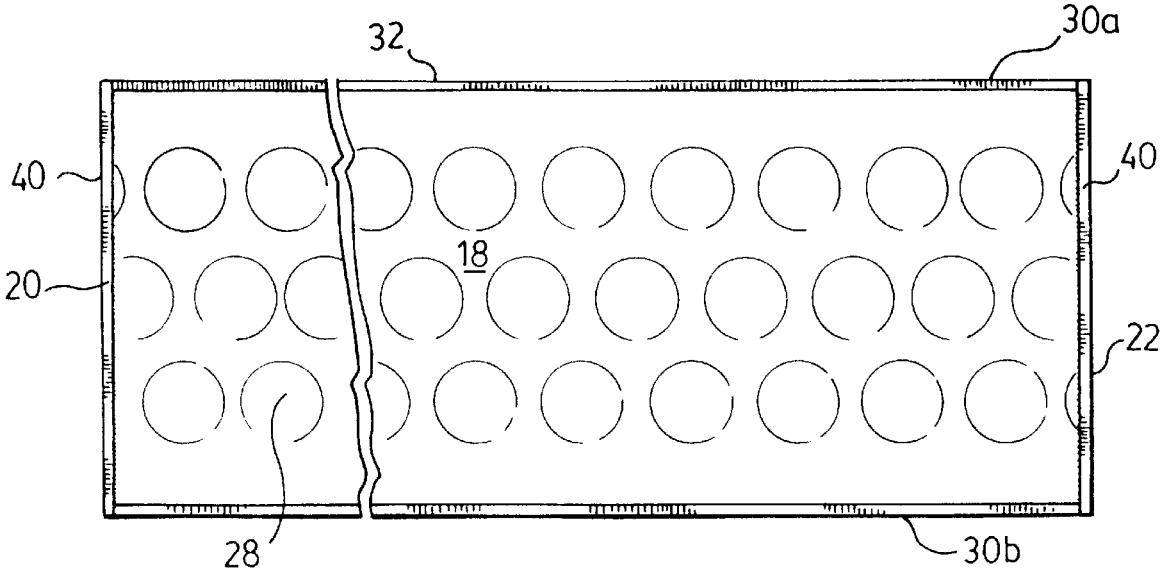
FIG.6.
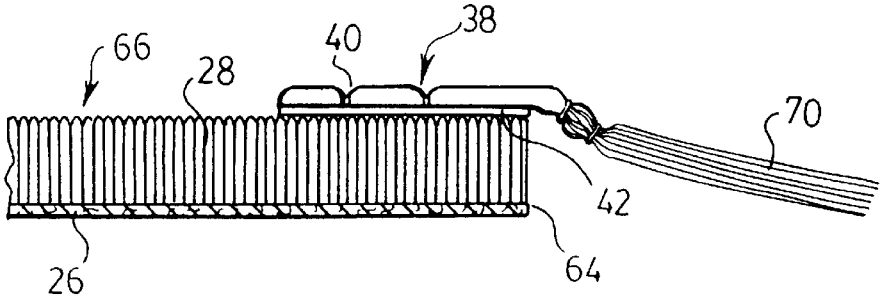

KIT FOR FINISHING CUT EDGES OF FLOOR COVERINGS

SCOPE OF THE INVENTION

The present invention relates to a finishing strip which is adapted to be secured along the cut edges of floor coverings and more particularly, a kit containing one or more finishing strips which permits an individual consumer to finish such a cut edge without the need for special tools.

BACKGROUND OF THE INVENTION

Floor coverings, such as floor runners and mats are frequently sold and dispensed in roll format. Conventional carpet rolls consist of an elongated carpet runner which is wound about a spool. Conventional carpet runners and mats are typically manufactured with stitching along each of their longitudinal edges to provide a finished and more aesthetically pleasing appearance. In addition, the edge stitching helps prevent the unraveling of carpet fibers as the carpet wears. Consumers purchase carpet runners and mats by the yard or meter, unrolling the desired length of runner from the spool, after which the unraveled length of carpet runner is cut transversely to its longitudinal length to separate it from a remainder of the roll.

A disadvantage with conventional roll carpet runners exists in that as carpet runners are cut to varying lengths depending upon the needs of the individual consumers, the purchased carpet runner is typically left with ragged cut ends which do not match the stitching of the factory formed longitudinal edges. In addition to being unsightly, the unfinished ends of the carpet tend to fray and separate.

Heretofore, if a retailer wished to sell variable lengths of carpet from a roll, or even carpet remnants with a finished edge, it has been necessary to send the carpet to a carpet finisher offsite to finish the edges. This increases the inconvenience to the carpet purchaser and may delay delivery of the finished product by several weeks.

Various individuals have proposed wooden or plastic trim pieces which are adapted to be secured over the cut ends of the carpet runner. In addition to causing discomfort if walked or stepped upon, conventional end trim pieces are typically unsightly and do not provide the purchased length of carpet runner with a factory or handmade appearance.

SUMMARY OF THE INVENTION

The present invention seeks to overcome at least some of the difficulties associated with prior art devices by providing a finishing strip which is adapted to be secured over the cut edge or end of a carpet runner, mat, or other floor covering.

Another object of the invention is to provide a kit which permits the attachment of a fabric strip over or along a cut edge of a floor covering without special tools, equipment or skills.

Another object of the invention is to provide a fabric strip which is adapted to be positioned so as to conceal the cut edge of a floor covering, and which has a fiber configuration and/or colour substantially corresponding to the fiber configuration and/or colour of any factory finished edges.

A further object of the invention is to provide an inexpensive and easily applied finishing strip which is adapted to be placed over the cut edge of a carpet runner and which prevents the end and/or stitched prefinished edges of the runner from fraying.

Another object of the invention is to provide for use in combination with a carpet runner roll, an edging strip comprising a fabric ribbon and an adhesive which may be used to permanently secure the ribbon over a cut end of a selected length of carpet runner.

Another object of the invention is to provide a kit which may be used in combination with a rolled carpet runner and which includes an adhesive backed serging ribbon having a length and width selected to permit its placement over a cut edge or end of the runner, and which has a fiber orientation which mimics the fiber orientation of any preformed factory stitched or formed edges of the runner.

The present invention provides a kit for use in finishing one or more cut edge of floor coverings such as mats, carpets and carpet runners. Most preferably, the kit is adapted to finish the cut ends of roll runners which are characterized by parallel and longitudinally extending preformed factory stitched or otherwise finished side edges. The kit includes a finishing or edging strip which is elongated in a longitudinal direction and which preferably has a length equal to or exceeding the length of the cut edge to be finished. The lateral width of the edging strip is selected so that when secured in place, the strip substantially covers and conceals the cut edge. Although not essential, more preferably, the lateral width of the finishing strip is selected greater than the maximum thickness of the floor covering along the cut edge, so as to overlap upper and/or lower edge portions of the floor covering immediately adjacent to the cut edge. The edging strip includes a flexible fabric or non-fabric ribbon or other suitable finishing strip. The ribbon may have various configurations, and may include without limitation, fabric ribbons, ribbons made from woven and/or knit fibers, ribbons made from serged fibers, and ribbons made from knotted fibers, with or without tassels. Most preferably the fabric has colour and/or fiber orientation which corresponds or complements the colour and/or fiber orientation of any factory finished edges on the uncut ends or sides of the floor covering. Most preferably, the ribbon comprises a serging ribbon having a medial portion with woven and/or elongated fibers oriented substantially perpendicular to the longitudinal length of the strip.

An attachment member is provided to permanently secure the ribbon in position substantially overlapping the cut edge. Suitable attachment members include adhesive tape or a bead of adhesive which permanently bonds the finishing strip to the floor covering. The adhesives may include either heat or non-heat activated glues provided at spaced locations or continuously along the cut edge. More preferably, however, the attachment member comprises a piece of two-sided tape having a length and width generally corresponding to that of the finishing strip. The two-sided tape is secured along a first side to the finishing strip, and a release sheet is carried by and releasably secured to the second other side of the tape. The release sheet is removed to activate the adhesive tape, whereupon the second side of the tape is pressed into contact with the floor covering to secure the finishing strip or ribbon in place.

Accordingly, in one aspect the present invention resides in a kit for finishing a cut edge of a floor covering comprising, a fabric strip, said strip being elongated in a longitudinal direction and having a lateral width selected greater than a maximum thickness of said floor covering along said cut edge, and an attachment member for securing said strip to said floor covering in a position substantially overlapping said cut edge, said attachment member including an adhesive for permanently bonding said strip to said floor covering.

In another aspect a kit for finishing a cut edge of a floor covering comprising, a finishing strip selected from fabric, woven fibers, knit fibers, serged fibers, knitted fibers, finishing strips, said strip being elongated in a longitudinal direction and having a lateral width selected greater than a maximum thickness of said floor covering along said cut edge, and an attachment member for securing said strip to said floor covering in a position substantially adjacent to said cut edge, said attachment member including an adhesive for permanently bonding said strip to said floor covering.

In another aspect, the present invention resides in combination a carpet roll and a carpet edging strip, the carpet roll having prefinished longitudinally extending side edges, and being adapted to be cut laterally into at least one carpet runner presenting an unfinished cut edge, the carpet edging strip including a ribbon elongated in a longitudinal direction and having a lateral width selected to substantially overlap said cut ends, and an adhesive strip for permanently securing said ribbon in overlying juxtaposition with a first one of said cut ends.

In a further aspect, the present invention resides in combination a carpet runner and a kit for finishing a cut edge of said carpet runner, the carpet runner having prefinished longitudinally extending side edges, and at least one generally laterally extending cut end, a kit including an edging strip comprising an elongate serge ribbon having a longitudinal length and a lateral width, the ribbon including a longitudinally extending medial portion characterized by at least 80% of said fibers being arranged in an orientation of between about ±60 to 90 degrees (ie. oriented in either direction), and more preferably about ±70 to 90 degrees, from the longitudinal direction of said ribbon, an adhesive strip of double-sided tape for securing said ribbon in overlying juxtaposition with said cut end, said double-sided tape having a longitudinal length and width substantially corresponding to that of said ribbon, a first side of said tape being aligned with and secured to a first side of said ribbon, and a release sheet being releasably secured to the second other side of tape.

BRIEF DESCRIPTION OF THE DRAWINGS

Reference may now be had to the following detailed description taken together with the accompanying drawings in which:

FIG. 4 shows a partial perspective bottom view of the carpet runner and edge strip of FIG. 3;

FIG. 5 illustrates a partial perspective top view of the carpet runner and edge strip of FIG. 3; and FIG. 6 illustrates a partial cross sectional view of a carpet with an edge strip in accordance with a further embodiment of the invention positioned thereon.

DETAILED DESCRIPTION OF THE PREFERRED EMBODIMENT

Figure 1:
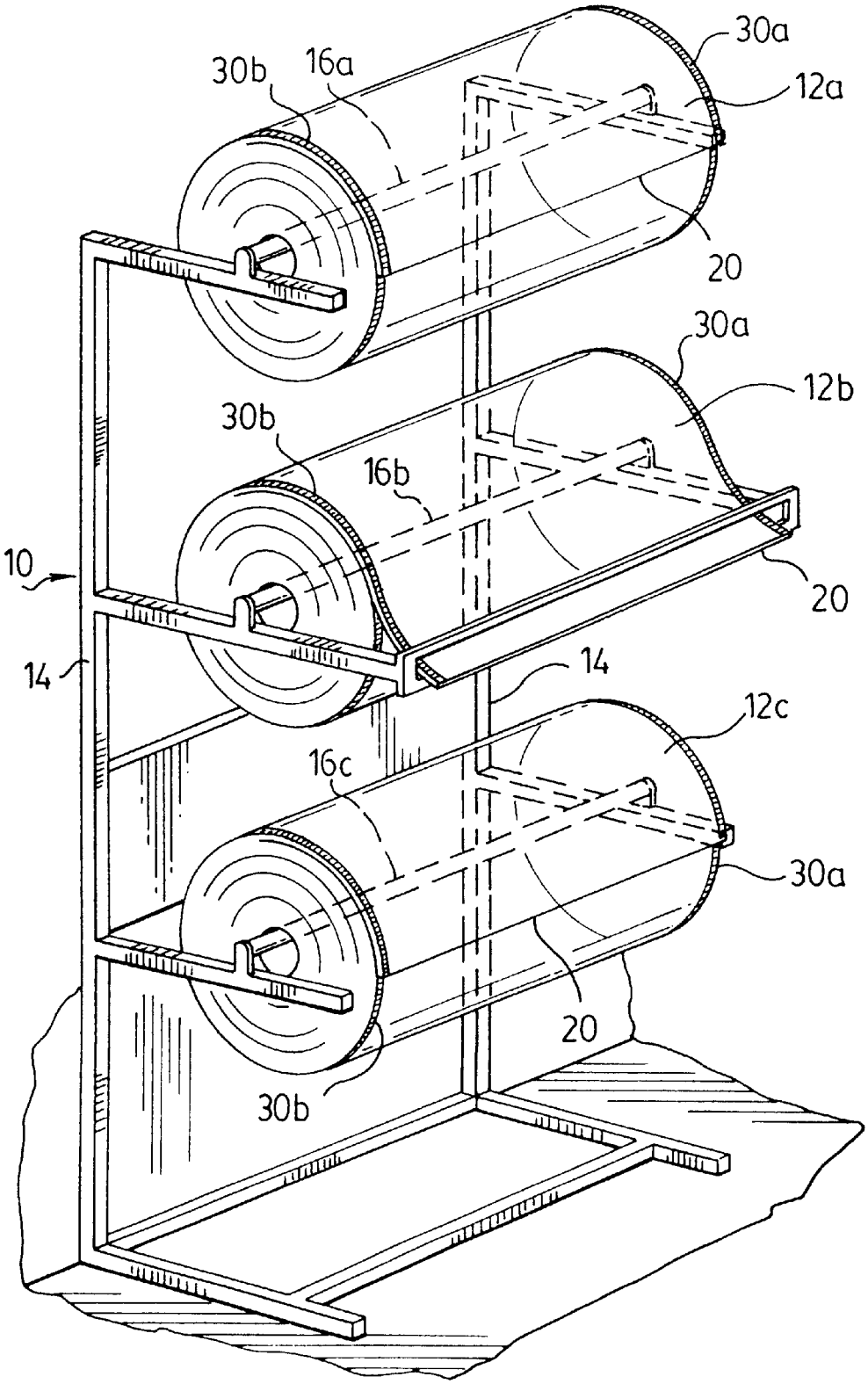
FIG. 1 illustrates schematically the storage and display of rolled carpet runners for use with the present invention.

FIG. 1 shows a roll runner display and dispensing stand 10 which is used in the display and dispensation of whole length floor runners which have been rolled along their longitudinal length into cylindrical carpet rolls 12*a*,12*b*,12*c*. The stand 10 includes a metal frame 14 which is used to mount a series of carpet roll supporting rods 16*a*,16*b*,16*c* which are inserted through the middle of each carpet roll 12*a*,12*b*,12*c*, respectively.

Each carpet roll 12*a*,12*b*,12*c* typically consists of an elongated continuous piece of carpet having a lateral width selected between about 2 and 6 feet, and an overall longitudinal length of between about 50 to 200 feet, depending upon the thickness of the carpet pile and the size of the display stand 10 used. In the use of the display stand 10, a desired length of carpet runner is uncoiled from a selected roll 12 in the longitudinal direction. A knife (not shown) is then drawn laterally across the width of the runner to sever the desired length of uncoiled carpet runner 18 (FIG. 3) from a remainder of the carpet roll 12. It is to be appreciated that each end of the severed carpet runner 18 is characterized by cut unfinished edges or ends, namely, a first cut end 20 (FIG. 1) formed upon the severing of the previous length of carpet runner (not shown) dispensed from the roll 12, with the second and opposing cut end 22 (FIG. 4) formed when the dispensed length of carpet runner 18 is severed.

Figure 3:
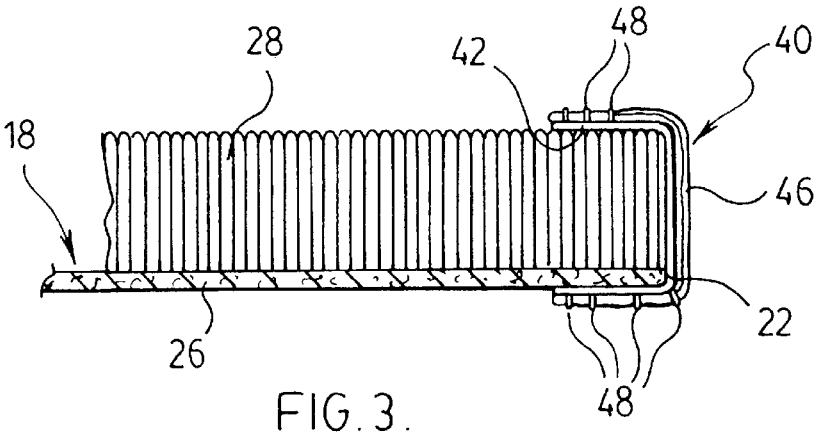
FIG. 3 shows a partial cross-sectional view of the cut end of a carpet runner with the edge strip of FIG. 2 in position secured thereto.

As shown best in FIG. 3, the carpet runner 18 includes a woven rubber, gel foam, plastic or other mesh or synthetic backing 26 onto which the carpet fibers 28 are secured by either gluing or weaving. Each longitudinal edge 30*a*,30*b* (FIG. 1) of the carpet runner 18 is prefinished during the manufacture of the roll 12. Most preferably, the edges 30*a*,30*b* are finished by stitching with a wool, nylon or other synthetic thread or fiber. Although not essential, as shown best in FIGS. 4 and 5 typically the stitching of the prefinished edges 30*a*,30*b* is done with the majority and preferably at least about 80% of the individual edging fibers 32 arranged in an orientation of between about ±60 to 90 degrees from the longitudinal extent of the edges 30*a*,30*b*. Most preferably, the fibers 32 are oriented approximately perpendicular to the longitudinal direction of the respective edges 30*a*,30*b*.

Figure 2:
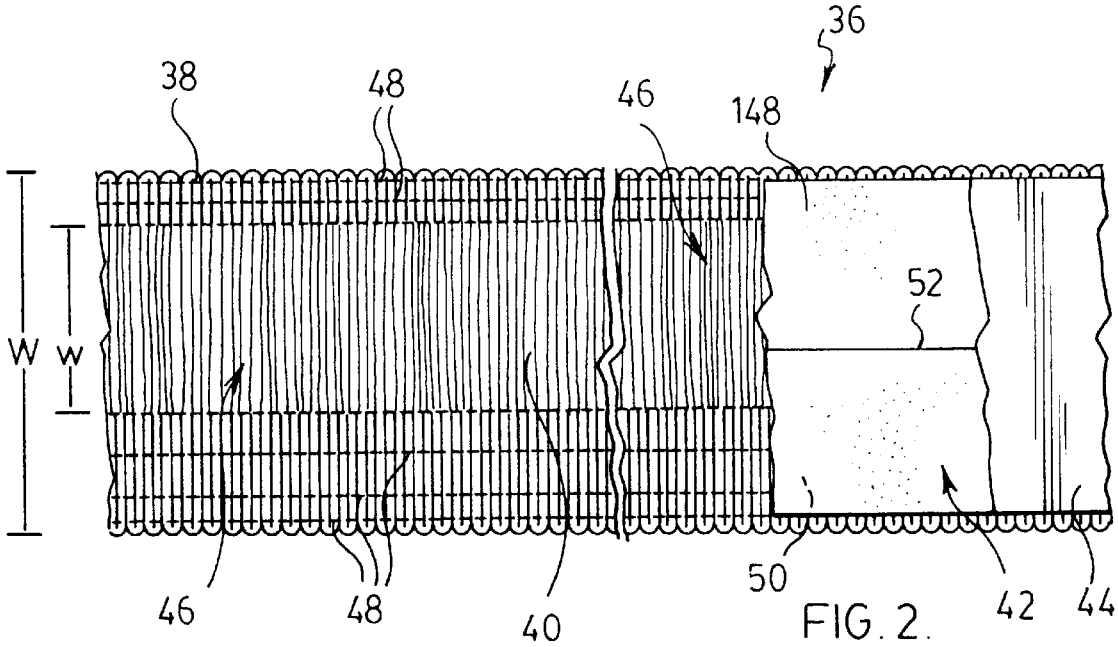
FIG. 2 illustrates schematically a partial cut away perspective view of a carpet edging strip for use in finishing a cut end of a carpet runner in accordance with a preferred embodiment.

As shown best in FIG. 2, to provide the dispensed length of carpet runner 18 with a factory finished or customized look and eliminate the exposure of aesthetically unpleasing cut carpet ends, the present invention further provides for an edge finishing kit 36 to be used in conjunction with the dispensed length of carpet runner 18. As will be described, the kit 36 is used to provide a factory finished or customized appearance to the carpet ends 20,22 which mimics the appearance of the factory prefinished edges 30*a*,30*b*.

The kit 36 most preferably consists of an elongated edging strip 38 for concealing the carpet ends 20,22 and instructions (not shown) used to guide the consumer in the application of the edging strip 38 to the carpet runner 18. Although not essential, edging strip 38 preferably has a longitudinal length greater than one and preferably both of the carpet ends 20,22. The edging strip 38 may be presented in a compact roll, and preferably consists of a fabric ribbon 40, an elongated strip of double-sided adhesive tape 42 and a release sheet 44 which, for example, may be formed from plastic, waxed or other coated papers.

FIG. 2 shows best the fabric ribbon 40 as comprising a serging fabric strip of woven fibers. The ribbon 40 has a lateral width W which is selected to overlap adjacent edge portions of both the carpet fibers 28 and the carpet backing 26 when positioned in overlapping juxtaposition with one of the runner ends 20,22. The ribbon 40 includes a medial portion 46 which is defined by one or more rows of edge stitching 48 which extend longitudinally the length of the ribbon 40. The medial portion 46 of the ribbon 40 is characterized by elongated wool, olefin, nylon or other synthetic fibers, of which at least 70%, and more preferably at least 80%, are arranged in an orientation of between about ±70 to 90 degrees relative to the direction of the longitudinal extent of the ribbon 40. It is to be appreciated that the edge stitching 48 provides the necessary strength and integrity to the ribbon 40 and maintains the desired orientation of the fibers which form the medial portion 46. The lateral width w of the medial portion 46 is also selected greater than the thickness of the cut ends 20,22 so that when the ribbon 40 is secured in place, the fibers which comprise the medial portion 46 extend substantially over a respective cut end 20,22 and a marginal distance over the carpet fibers 28 which locate immediately adjacent thereto.

Preferably, the ribbon 40 has a colour which is complementary, and more preferably substantially identical to the colour of the fibers 46 used to form the prefinished side edges 30*a*,30*b* of the carpet runner 18.

FIG. 2 shows best the double-sided adhesive tape 42 as comprising an elongated rectangular strip of material having a length and width substantially corresponding to the longitudinal length and lateral width of the serging ribbon 40. A first side 48 of the double-sided tape 42 is bonded to the back of the ribbon 40, aligned therewith. The release sheet 44 is positioned over the second other rear side 50 of the double-sided tape 42 so as to prevent the rear side 50 of the tape 42 from accidentally bonding to the ribbon 40 when coiled.

Optionally, the double-sided tape 42 and/or release sheet 40 may be provided with visual indicia 52 (FIG. 2) to assist a user in the correct positioning of the strip 38 along an end 20,22 and/or to determine the desired length of ribbon 40 required to cover a cut end 20,22. Although not essential, the double-sided tape 42 is preferably a clear transparent tape so as to minimize the possibility that the tape 42 may create an unsightly or aesthetically unpleasing appearance when the ribbon 40 is installed. Most preferably, a longitudinally extending thread 52 of contrasting colour is provided between the ribbon 40 and tape 42 to assist the user in aligning the strip 38 in the correct position.

The tape 42 is selected to comply with five regulations and may, for example, comprise latex based or low volatile adhesives on a synthetic or natural rubber based backing film.

In use of the invention, the individual purchases a desired length of carpet runner 18 in the manner previously described, together with an edge finishing kit 38 which contains one or more serging ribbons 40 having a complementary or identical colour to that of the prefinished longitudinal side edges 30*a*,30*b* of the carpet runner 18 purchased.

To finish the cut end 22 of the carpet runner 18, a length of edging strip 38 is either cut or is supplied in pre-cut lengths approximately 3 to 6 inches longer than the length of the cut end 22 (FIG. 3) to be finished. The release sheet 44 is removed from the back side 50 of the cut length of tape 42 by peeling it away, to expose the adhesive on the back side 50 of the tape 42. As shown best in FIGS. 3 and 4, the double-sided tape 42 is then aligned with and pressed against the carpet end 22, to secure it together with the ribbon 40 in a position partially overlapping not only the cut edge 22 itself, but an adjacent portion of the carpet backing 26 and the carpet fibers 28 immediately adjacent thereto. The tape 42 and ribbon 40 are secured in place so that the medial portion 46 of the ribbon 40 extends substantially upwardly across the cut end 22, and over approximately one-quarter to three-quarters of an inch of the carpet fibers 28 immediately adjacent the end 22. As shown in FIG. 4, at each comer of the carpet runner 18 where the cut end 22 meets the prefinished edges 30*a*,30*b*, the ribbon 40 is folded back under the carpet runner 18 at approximately a 30 to 60 degree angle. The adhesive tape 42 of the edging strip 38 is bonded to the carpet backing 20 to secure the folded under portion 56 of the strip 38 against the carpet 18. The opposite cut end 20 is finished in the identical manner.

It is to be appreciated that when the ribbon 40 is secured over the ends 20,22, the fibers of the medial portion 46 of the serging ribbon 40 assume an orientation approximately perpendicular to the longitudinal extent of the end 20,22, just as the fibers of the prefinished edges 30*a*,30*b* are oriented generally perpendicular to the longitudinal edge of each side. As a result, as shown best in FIG. 5, the carpet runner 18 visually appears to have factory preformed edges, not only along each longitudinal side edge 30*a*,30*b*, but also across each cut end 20,22, creating a more visually pleasing appearance. The attachment of the serging ribbon 40 further advantageously prevents the carpet fibers and/or the stitching of the preformed edges 30*a*,30*b* adjacent to the cut ends 20,22 from fraying.

The use of double-sided tape 42 has been found to be preferred in that it assists in maintaining the desired fiber orientation of the medial portion 46 of the serging ribbon 40, minimizing the likelihood that the fibers may be torn or pulled apart with carpet wear or vacuuming. Similarly, the use of a clear transparent double-sided tape 42, while not essential, advantageously minimizes the likelihood that the tape 42 will leave an unsightly appearance if, for example, the fibers of the serging ribbon 40 pull or separate from each other.

While the preferred embodiment of the invention describes a finishing strip having a serging ribbon 40, the invention is not so limited. If desired, other fabric and non-fabric finishing ribbons or strips could equally be used depending on the appearance of the edge to be achieved.

Although the disclosure describes the placement of the serging ribbon 40 over the cut ends 20,22 of a carpet runner 18, it is to be appreciated that the invention may be used to conceal the unfinished edges of various different types of floor coverings. Reference may be had to FIG. 6 which illustrates an edging strip 38 used to conceal a cut edge 60 of a carpet 62 in accordance with a further embodiment, wherein like reference numerals are used to identify like components. In FIG. 6, the edging strip 38 comprises an elongated woven or knit ribbon 40 which is secured over the cut edge 64 of a carpet 66 by a strip of double sided tape 42. To better conceal the edge 64, the knit ribbon 40 includes tassels 70 extending from one longitudinal edge of the strip 38.

The knit ribbon 40 is secured in place by first removing a release sheet (not shown) from the back of the tape 42. The ribbon 40 is then positioned with the double sided tape 42 overlying the carpet fibers 28 immediately adjacent to the cut edge 64, so that the tassels 70 extend beyond and conceal the edge 64.

While the disclosure describes the use of a double sided tape 42 as an attachment member used to secure the ribbon 40 in position, the invention is not so limited. It is to be appreciated that a single-sided adhesive tape which is chemically bonded or physically attached to the ribbon 40, as for example by stitching, could also be used. Similarly, hot melt adhesives, non-heat activated adhesives and epoxies or even mechanical fasteners could also be used with the edging strip 38, without departing from the spirit and scope of the invention.

Although the disclosure describes and illustrates various preferred embodiments, the invention is not so limited. Many modifications and variations will now occur to persons skilled in the art. For a definition of the invention, reference may be had to the appended claims.

We claim:

1. In combination a carpet roll and a carpet edging strip, carpet roll having prefinished longitudinally extending side edges, and being adapted to be cut laterally into at least one carpet runner presenting at least one unfinished cut edge, the carpet edging strip for placement over a first cut edge including a ribbon elongated in a longitudinal direction and having a lateral width selected to substantially overlap said first cut edge, said ribbon having a colour substantially corresponding to a colour of said prefinished longitudinal side edges, and an adhesive strip for placement in a position generally interposed between said ribbon and said first cut edge to permanently secure said ribbon in overlying juxtaposition with said first cut edge, and wherein said ribbon comprises a serging ribbon including a medial portion having a lateral width selected greater than a thickness of said first cut edge, said medial portion characterized by a plurality of elongated fibers being arranged in an orientation extending generally perpendicular to the longitudinal extent of said ribbon.

2. The combination as claimed in claim 1 wherein said elongated fibers have a colour selected to substantially correspond to a colour of said prefinished side edges.

3. The combination as claimed in claim 1 wherein said edging strip further includes visual indicia to assist in guiding the positioning of the strip over said cut edge.

4. In combination a carpet roll and a carpet edging strip, the carpet roll having prefinished longitudinally extending side edges, and being adapted to be cut laterally into at least one carpet runner presenting an unfinished cut edge, the carpet edging strip for placement over said cut edge including a ribbon elongated in a longitudinal direction and having a lateral width selected to substantially overlap said cut edge, said ribbon having a colour substantially corresponding to a colour of said prefinished longitudinal side edges, and an adhesive strip for placement in a position generally interposed between said ribbon and said cut edge to permanently secure said ribbon in overlying juxtaposition with said cut edge, and wherein said ribbon includes a medial portion having a lateral width selected greater than a thickness of said cut edge, said medial portion characterized by elongated fibers being arranged in an orientation of between about ±60 to 90 degrees relative to the longitudinal extent of said ribbon.

5. The combination of claim 4 wherein said adhesive strip comprises double-sided adhesive tape.

6. The combination of claim 5 wherein a first side of said double-sided adhesive tape is preapplied to a first planar side of said ribbon, and further comprising a release sheet releasably positioned over the second other side of said double-sided tape.

7. The combination of claim 6 wherein said adhesive strip has a longitudinal length and lateral width substantially corresponding to the length and width of said ribbon.

8. The combination of claim 1 wherein said prefinished longitudinal side edges are characterized by sewn fibers having an orientation generally perpendicular to the longitudinal extent of said prefinished side edges.

9. The combination of claim 6 wherein said double-sided tape comprises a substantially clear tape, and further comprises visual indicia to assist in guiding the positioning of the ribbon into a position juxtaposed with said cut edge.

10. The combination as claimed in claim 4 wherein said edging strip further includes visual indicia to assist in positioning said adhesive strip over said cut edge.

11. In combination a carpet runner and a kit for finishing a cut end of said carpet runner, the carpet runner having prefinished longitudinally extending side edges, and at least one generally laterally extending cut end, a kit including an edging strip comprising an elongate serging ribbon having a longitudinal length and a lateral width, the ribbon including a longitudinally extending medial portion characterized by at least 80% of said fibers being arranged in an orientation of between about ±60 to 90 degrees from the longitudinal direction of said ribbon, an adhesive strip of double-sided tape for placement generally interposed between said serging ribbon and said cut end to secure said ribbon in overlying juxtaposition with said cut end, said double-sided tape having a longitudinal length and width substantially corresponding to that of said ribbon, a first side of said tape being aligned with and secured to a first side of said ribbon, and a release sheet being releasably secured to the second other side of tape.

12. The combination as claimed in claim 11 wherein said ribbon has a colour substantially corresponding to a colour of said prefinished longitudinal side edges.

13. The combination of claim 11 wherein said double-sided tape comprises a substantially clear tape.

14. The combination as claimed in claim 11 further including visual indicia to assist in guiding the positioning of the ribbon in a position substantially juxtaposed with said cut end, the visual indicia comprising a longitudinally extending coloured thread interposed between at least one of the ribbon and the adhesive strip, and the adhesive strip and the release sheet.

* * * * *